United States Patent [19]

Miller et al.

[11] 3,953,764

[45] Apr. 27, 1976

[54] METHOD AND MEANS FOR SELECTIVELY POSITIONING A LIGHT SOURCE FOR ILLUMINATING FILM TRANSPARENCIES

[75] Inventors: Edward Miller, Levittown; Anthony P. Latella, Huntingdon Valley, both of Pa.

[73] Assignee: Delta-X Corporation, Levittown, Pa.

[22] Filed: Sept. 29, 1971

[21] Appl. No.: 184,850

[52] U.S. Cl. ..... 315/386; 315/30; 315/31 R; 178/6.8; 40/106.1; 358/51

[51] Int. Cl.[2] ..... H01J 29/70

[58] Field of Search ..... 315/22, 30, 31, 386; 178/5.4 M, 6.8, 7.7, DIG. 3; 40/106.1

[56] References Cited

UNITED STATES PATENTS

| | | | |
|---|---|---|---|
| 2,717,329 | 9/1955 | Jones et al. | 178/DIG. 3 |
| 3,249,691 | 5/1966 | Bigelow | 178/6.8 |
| 3,423,749 | 1/1969 | Newcomb | 315/22 X |
| 3,437,873 | 4/1969 | Eggert | 315/22 |
| 3,614,766 | 10/1971 | Kievit | 315/22 X |
| 3,648,098 | 3/1972 | Talbert | 315/30 X |
| 3,659,144 | 4/1972 | Flemming | 315/22 X |

*Primary Examiner*—Samuel W. Engle
*Assistant Examiner*—Peter A. Nelson
*Attorney, Agent, or Firm*—Ostrolenk, Faber, Gerb & Soffen

[57] ABSTRACT

A light source for illuminating film transparencies is in the form of a cathode-ray tube provided with electronic circuitry which causes the beam of the tube to trace a raster on the screen. The circuitry is such that the area of the raster and its position on the screen can be selectively controlled by the observer for illuminating predetermined portions of the screen. The observer can thus illuminate only that portion of the film transparency of particular interest to him, and can select the intensity of illumination by controlling the electron beam intensity. The raster is developed by sweeping the beam in the horizontal and vertical directions at different speeds using a sweep wave form that is of a symmetrical triangular shape thus eliminating the necessity for blanking the beam as the raster is developed.

5 Claims, 2 Drawing Figures

INVENTORS
EDWARD MILLER
ANTHONY P. LATELLA
BY
Seidel, Gonda & Goldhammer
ATTORNEYS.

METHOD AND MEANS FOR SELECTIVELY POSITIONING A LIGHT SOURCE FOR ILLUMINATING FILM TRANSPARENCIES

DETAILED DESCRIPTION

Figure 1:
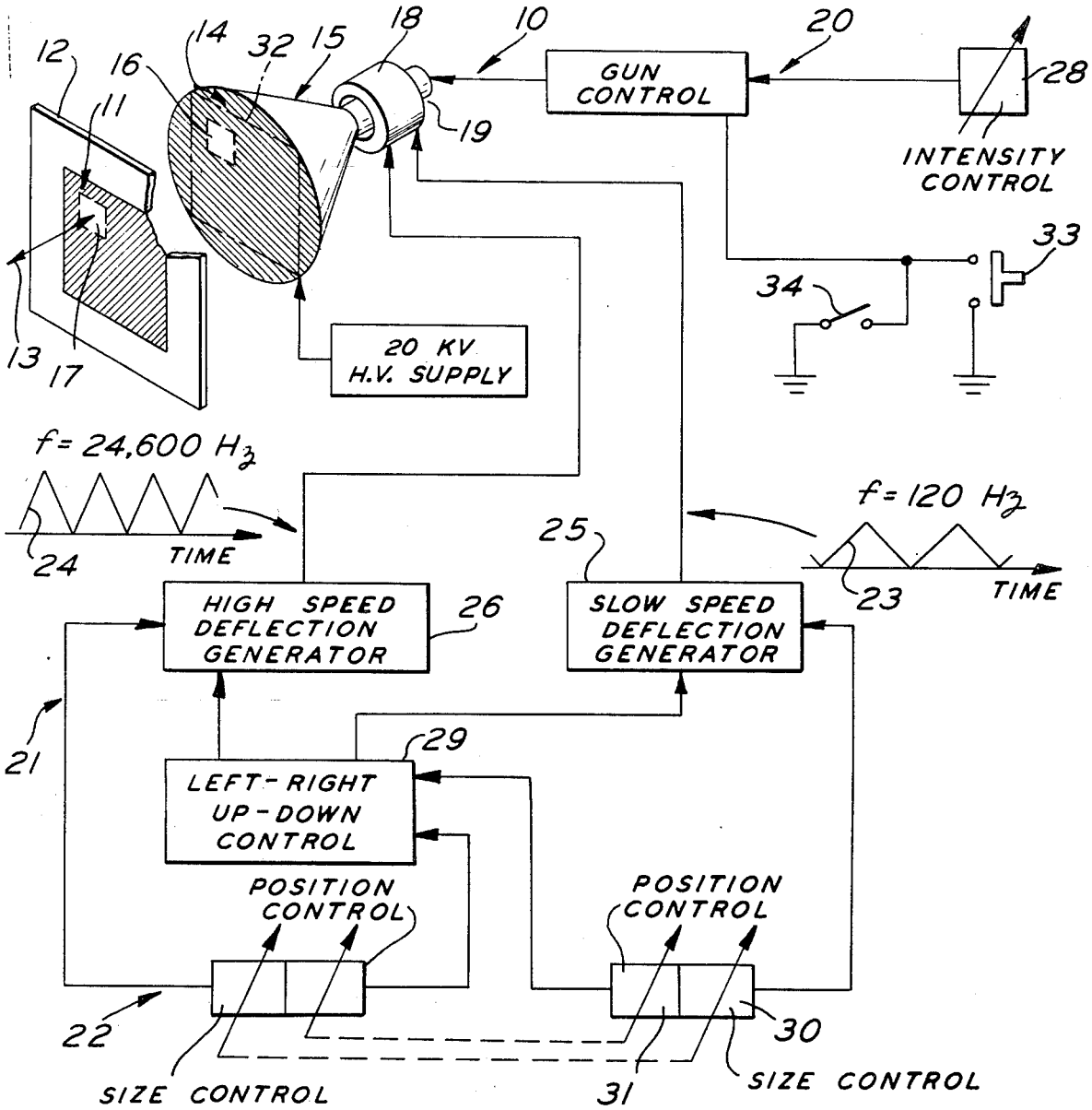

This invention relates to a light source for illuminating film transparencies, and is particularly useful for analyzing radiographs.

The traditional approach to studying radiographs has been to view the transparency against a diffuse translucent screen behind which is located a high intensity uniform light source. Such screen is uniformly illuminated and furnishes viewing light of the same intensity per unit area to each elemental area of the transparency. When the transparency is a radiograph of a human or animal subject, a wide variation in density exists between regions of the radiograph representing tissue and regions representing bone. Considering the transparency as a whole, the uniform illumination is adequate to permit a gross interpretation to be made. Often, however, an observer is particularly interested in a small region of the transparency that may be of a high or low density relative to the average density of the transparency. Generally speaking, the intensity of light furnished by a diffuse screen to a region of high density representing bone structure is usually somewhat lower than is adequate for the human eye to resolve small differences in brightness in such region that are of interest to an observer. If such region is adjacent a low density area, increasing the intensity of light furnished by a diffuse screen to the level necessary to permit adequate interpretation of the high density region, produces a glare which interferes with proper brightness discrimination in the region of interest. On the other hand, the intensity of light furnished to a region of low density representing tissue is usually somewhat higher than the optimum.

One solution to this problem is to illuminate the transparency with a light whose intensity at each elemental area is functionally related to the density of the transparency at such area. This approach is disclosed in U.S. Pat. No. 3,249,691 issued May 3, 1966 wherein the light source is the screen of a cathode-ray tube whose beam scans the screen in a raster using the standard F.C.C. approved scan of 60 interlaced fields per second of 262-½ lines per field. The intensity of the beam is controlled by a photo responsive sensor which views the screen in the same way as an observer, namely through the film transparency. The sensor provides a feedback signal that will increase the intensity of the beam when it impinges on an elemental area of the screen directly behind a high density elemental area of the film transparency, and will decrease the density if the elemental area of the film transparency is low.

While this solution is probably adequate for many purposes, it is apparent that the afterglow of the cathode-ray tube screen phosphors produces what amounts to a background illumination level over the whole film transparency being viewed, which level depends on the average density of the film transparency as a whole. Depending upon the film transparency being viewed, the background level may interfere with the modulating effect of the photo sensor, and not provide adequate enhancement of the preselected portion of the film transparency that the observer wishes to particularly study.

The primary object of the present invention, therefore, is to provide a light source for viewing film transparencies, which source is concerned, not with providing enhancement of the entire transparency which will be adequate on the average, but with providing illumination only in an isolated region of the film transparency selected by an observer, and at a level that is optimum for the region selected.

Briefly, this and other objects of the present invention are achieved by utilizing as a light source, the screen of a cathode-ray tube on which can be developed a raster whose intensity, size and position on the screen can be manually adjusted by an observer to meet the requirements of the particular area on the film transparency of interest to the observer. The raster is achieved by sweeping the beam of the cathode-ray tube in a horizontal and vertical direction at different speeds using a sweep wave form that is a symmetrical triangle permitting the beam to remain on during the entire sweep and producing the maximum light from the screen. Blanking of the beam usually associated with development of a raster is eliminated. Preferably, the slow speed scan occurs at a frequency of 120 Hz., and high speed scan at 24,600 Hz. producing interlaced fields.

Figure 2:
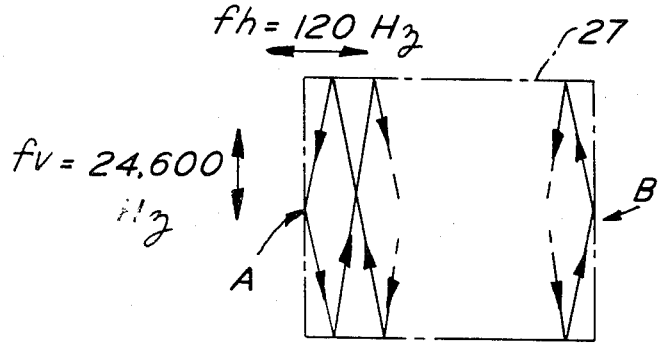

The features of this invention for which protection is sought are pointed out with particularity in the appended claims. The invention itself, however, both as to its organization and method of organization, together with further objects and advantages thereof, may best be understood by reference to the following description taken in connection with the accompanying drawings, wherein like parts in each of the several figures are identified by the same reference character, and wherein:

FIG. 1 is a block diagram showing the components of the light source of the present invention; and FIG. 2 is a schematic representation of the manner in which the raster is developed on the screen of the cathode-ray tube.

Referring now to FIG. 1, reference numeral 10 designates the light source of the present invention as used in conjunction with viewing radiograph 11 which is mounted in a conventional manner on frame 12 for inspection and study by observer 13. Frame 12 is located between the observer and target screen 14 of cathode-ray tube 15 which is positioned close to screen 14.

As indicated previously, light source 10 is capable of developing a spot of light 16 of selectively controlled intensity on screen 14. The size and location of the spot on the screen is also selectively controlled by the observer. In this manner, the observer may first illuminate the entire effective area of the screen to inspect radiograph 11 in a conventional manner and select the portion 17 of the radiograph which is of particular interest for closer study. Thereafter, the observer can reduce the area of illumination to approximate the area of the portion of interest, and position the light spot directly behind such portion, adjusting the intensity of illumination to a level that is optimum for the density of the portion of the radiograph that is of interest. This process can be followed to permit the study of each selected portion of the radiograph of interest to the observer.

To achieve these results, light source 10 utilizes cathode-ray tube 15 provided with conventional deflection yoke 18, electron gun 19, intensity controls 20, sweep means 21 and size and position controls 22. The power supply for the electron gun, the sweep means, and the accelerating voltage for the tube is conventional and is not shown. In the preferred form of the invention, yoke 18 includes horizontal and vertical coils (not shown). To the horizontal coil is applied a sweep signal in the form of a symmetrical triangular wave 23 of a frequency of 120 Hz.; and to the vertical coil is applied a sweep signal in the form of a symmetrical triangular wave 24 of a frequency of 24,600 Hz. The horizontal sweep is developed by slow-speed deflection generator 25; and the vertical sweep is developed by high-speed deflection generator 26. Both generators maintain the triangular wave shape over a wide variation in amplitude of the output.

Referring now to FIG. 2, phantom lines 27 encompass the area covered by the raster developed by the electron beam under the control of the horizontal and vertical sweep signals of given amplitude. The sweep frequencies have been chosen in order to achieve a proper interlace between each field of the raster which is produced at the rate of 60 times per second. If the scan starts at point A, midway on one side of region 27, the first field will be completed when the beam reaches point B at the opposite side of region 27. At this time the horizontal sweep will reverse in direction causing a proper interlace between the second field and the first field. It should be noted that no blanking of the electron gun is involved in this system of scanning. Rather, the electron beam of the cathode-ray tube is on 100 percent of the time providing for the most efficient illumination of the screen. The observer controls the intensity of the beam and hence the brightness of the raster on the screen of the cathode-ray tube by selective manipulation of intensity control knob 28.

The amplitude of the sweep signal developed by generators 25 and 26 is determined by control 29 as influenced by the setting of size control knob 30. By controlling the amplitude of the sweep signals, the size of the raster produced on screen 14 of cathode-ray tube 15 is established. The position of the raster on the screen 14 is determined by the setting of position control knob 31. By properly adjusting control knobs 30 and 31, the raster appearing on screen 14 of the cathode-ray tube can be varied from a fixed minimum value, which depends on the linearity of the components of generators 25 and 26, to the maximum size permitted by screen 14. Such maximum size is indicated in FIG. 1 by phantom lines 32. The intensity of spot 16 is controlled by the setting of knob 28.

In operation, an observer would adjust control knobs 30 and 31 until spot 16 on target 14 of the cathode-ray tube covers the entire area bounded by phantom lines 32. Control knob 28 would also be adjusted by the observer until the intensity of light on screen 14 is adequate to permit him to examine the radiograph 11 from an overall point of view. When the radiograph is much larger in area than the area comprehended by phantom lines 32, it may be necessary to shift frame 12 until the entire radiograph has been examined.

After the observer determines which region of the radiograph he is interested in studying in more detail, size control knob 30 may be adjusted to reduce the size of the spot from the entire area comprehended by phantom lines 32 to an area approximately the same size as the region 17 of interest to the observer. By suitably adjusting the position control knob 31, the observer can move spot 16 throughout the entire region comprehended by phantom lines 32 in FIG. 1 until spot 16 is directly behind region 17. When this occurs, the observer, by adjusting knob 28, can change the intensity of the light at spot 16 to a level which is optimum for the density of the region 17 being studied.

By reason of the above described arrangement, the observer views only the portion of interest on the radiograph and his eyes are not required to reject light from other regions of the radiograph which are of no interest. As a consequence, the viewing ability of the observer is enhanced, and his peripheral vision is not degraded.

The electron beam produced by gun 19 can be entirely suppressed when the observer depresses pushbutton switch 33 or closes foot operated switch 34. By this arrangement, the observer may, at his option, switch the cathode-ray tube to a standby state at which screen 14 contains no illumination. Upon the release of pushbutton 33 or the opening of switch 34, spot 16 appears at a level of illumination determined by the setting of intensity control 28.

The phosphors used in screen 14 of the cathode-ray tube are selected to provide a relatively high degree of afterglow. The color of the light produced by screen 14 is essentially white.

The present invention may be embodied in other specific forms without departing from the spirit or essential attributes thereof and, accordingly, reference should be made to the appended claims, rather than to the foregoing specification as indicating the scope of the invention.

What is claimed is:

1. A light source for illuminating a film transparency from one side to permit an observer to view the image on the transparency from the other side, said source comprising:

a cathode-ray tube having a target screen facing said one side of said transparency and an electron gun for producing a beam of electrons that impinge upon an elemental area of said screen illuminating said screen;

a first deflection means for deflecting the beam of said cathode-ray tube along a first predetermined direction at a first predetermined frequency;

a second deflection means for deflecting the beam of said cathode-ray tube along a second predetermined direction substantially perpendicular to said first predetermined direction at a second predetermined frequency, said second predetermined frequency being substantially greater than said first predetermined frequency, said first and second deflection generators both being operative to cause said beam to scan said screen defining an illuminated raster for illuminating at least a portion of said film transparency, said beam being on continuously during the generation of the raster;

control means, said control means supplying control signals to said first and second deflection means to control the position of said raster on said screen; and means for supplying signals to said first and second deflection means to control the size of said raster on said screen thereby enabling the illumination of a predetermined portion of said film transparency.

2. A light source according to claim 1 wherein said cathode-ray tube is provided with vertical and horizontal beam deflecting means, and wherein said first deflection means produces a horizontal sweep signal which is applied to said horizontal beam deflecting means, and wherein said second deflection means produces a vertical sweep signal which is applied to said vertical beam deflecting means, each of said first and second deflection means producing sweep signals having a symmetrical triangular wave form.

3. A light source according to claim 2 including a manually operable intensity control for establishing the intensity of said electron beam whereby the intensity of illumination of said predetermined portion of said screen may be manually controlled.

4. A light source according to claim 3 including operable beam suppression means, and a manually actuatable switch for operating said beam suppression means.

5. A light source according to claim 2 wherein said deflection means produces a horizontal sweep signal at a rate of 120 Hertz and said second deflection means produces a vertical sweep signal at a rate of 24,600 Hertz.

* * * * *